US006154183A

United States Patent [19]

Wolf

[11] Patent Number: 6,154,183

[45] Date of Patent: Nov. 28, 2000

[54] WAVEGUIDE ANTENNA

[75] Inventor: Helmut Wolf, Holzkirchen, Germany

[73] Assignee: DaimlerChrysler AG, Stuttgart, Germany

[21] Appl. No.: 09/240,854

[22] Filed: Feb. 1, 1999

[30] Foreign Application Priority Data

Jan. 30, 1998 [DE] Germany ..... 198 03 565

[51] Int. Cl.[7] ..... H01Q 13/02

[52] U.S. Cl. ..... 343/786; 343/756; 333/21 A

[58] Field of Search ..... 343/786, 756; 333/21 A, 137, 26

[56] References Cited

U.S. PATENT DOCUMENTS

| | | | |
|---|---|---|---|
| 3,603,987 | 9/1971 | Witte | 343/786 |
| 3,680,138 | 7/1972 | Wheeler | 343/756 |
| 4,051,447 | 9/1977 | Heckman, Jr. | 333/24 R |
| 4,097,869 | 6/1978 | Robinson | 343/773 |

FOREIGN PATENT DOCUMENTS

| | | |
|---|---|---|
| 0 071 069 A2 | 2/1983 | European Pat. Off. . |
| 0 543 509 A2 | 5/1993 | European Pat. Off. . |
| 31 50 236 A1 | 6/1983 | Germany . |
| 40 38 817 C1 | 5/1992 | Germany . |
| 42 13 539 A1 | 10/1992 | Germany . |
| 0 821 431 A2 | 1/1998 | Germany . |

*Primary Examiner*—Michael C. Wimer
*Attorney, Agent, or Firm*—Evenson, McKeown, Edwards & Lenahan, P.L.L.C.

[57] ABSTRACT

A waveguide antenna has two orthogonal feeds from coaxial conductors into a round or square waveguide sections. The feeds are coupled into the waveguide section by first and second coupling devices arranged orthogonally about the main axis of the antenna.

3 Claims, 1 Drawing Sheet

WAVEGUIDE ANTENNA

BACKGROUND AND SUMMARY OF THE INVENTION

This application claims the priority of German patent document 198 03 565.9, filed Jan. 30, 1998, the disclosure of which is expressly incorporated by reference herein.

The invention relates to a waveguide antenna which includes a waveguide section with an aperture and a shorting wall, as well as a coaxial feed and a transition from the coaxial feed to the waveguide antenna.

A hollow waveguide antenna of this type known from German patent document DE 42 13 539 A1 has a straight waveguide section with a circular cross section, one end of which is sealed by a shorting plate. The other end terminates in a horn antenna. An axially extending rod mounted on the shorting plate and two orthogonal coupling pins form a transition from a coaxial feed to a waveguide. In addition to coupling the orthogonally supplied waves, this design has the disadvantages that the feed occupies considerable space in the radial direction around the waveguide, and that a horn antenna is required for shaping the radiation pattern.

German patent document DE 40 38 817 C1 discloses a coupling device for two waveguide systems extending in superimposed planes. While this transition has proved satisfactory, this reference contains no suggestion that such a coupling device could be used in conjunction with a waveguide antenna, or how such might be accomplished.

A radiator for array antennas disclosed in from U.S. Pat. No. 3,680,138, which however is suitable only for radiating linearly polarized electromagnetic radiation. No mention is made of how a circularly polarized wave could be radiated, or how the shaping of the antenna pattern could be optimized.

The goal of the present invention is to provide a waveguide antenna with coaxial feed which can be used with both round waveguides and square waveguides, which has no parts that extend radially beyond the waveguide wall and which, despite its short axial length, has electrical power parameters that are as least as good as those of patch or slot antennas for example.

These and other objects and advantages are achieved by the waveguide antenna structure according to the invention, which includes a round or square waveguide section which is fed by two orthogonal feeds from coaxial conductors. The feeds are coupled into the waveguide section by first and second coupling devices which are arranged orthogonally about the main axis of the antenna. The waveguide section has a shorting plate at one end and an opening at the other end, and a length $L=L_o+1$, wherein $L_o=\frac{1}{4}\lambda$, $\lambda$ equals the operating wavelength of the antenna and 1 is less than $\lambda$, and 1 is the clearance between the length of the coupling devices and the length of the waveguide section.

The particular advantage of the waveguide antenna according to the invention is that it avoids the above disadvantages of conventional designs, and with a length of only slightly more than ¼ of the operating wave length, has only a very slight coupling of the orthogonal wave components and a broadband characteristic. It also allows mounting in a tightly packed array, so that by means of simple adaptation measures, the coupling between adjacent antennas can be considerably reduced.

Other objects, advantages and novel features of the present invention will become apparent from the following detailed description of the invention when considered in conjunction with the accompanying drawings.

DETAILED DESCRIPTION OF THE DRAWINGS

Figure 1:
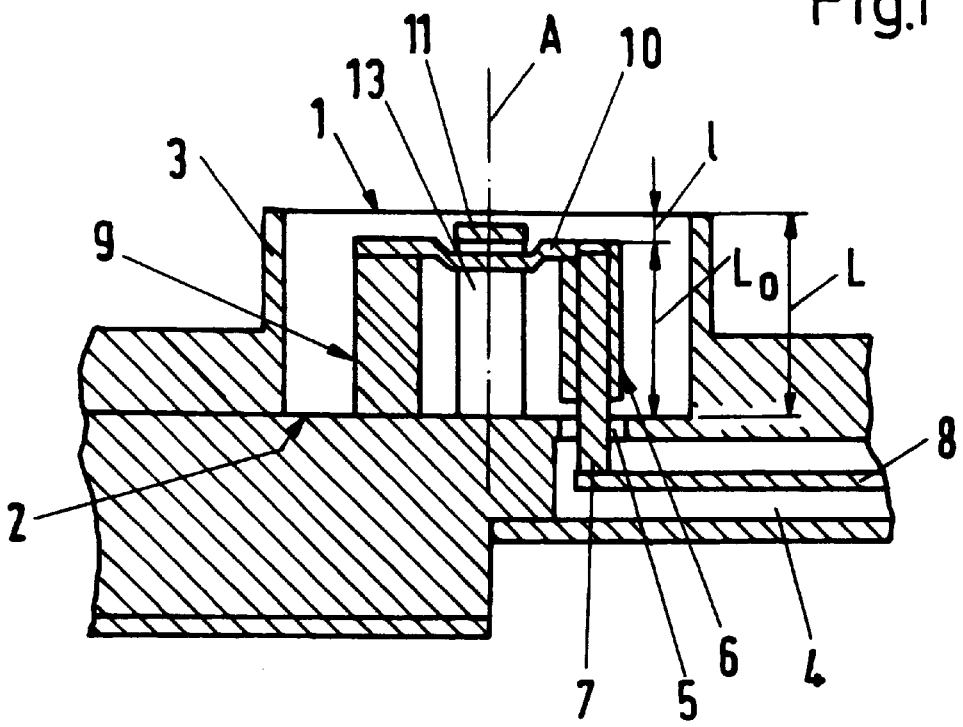
FIG. 1 shows a section through a transition from a coaxial antenna to a waveguide antenna.

In FIG. 1, a waveguide antenna 1 consists of a waveguide section 3 and a shorting wall 2, and has a circular aperture with the diameter of waveguide section 3. The coaxial feed 4 terminates below shorting wall 2, and is connected to the waveguide section 3 through an opening 5 in shorting wall 2, through which a capacitatively acting coaxial probe 6 is guided. This probe 6 (such as described, for example in German patent document (DE 40 38 817) C1 is connected by terminal 7 with a central conductor 8 of coaxial feed 4. The end of capacitatively acting coaxial probe 6 on the aperture side is fastened to a shorting strap 10 that extends parallel to shorting wall 2. Another probe 9 with a similar external shape is located symmetrically with respect to main axis A of waveguide antenna 1. The latter probe is permanently connected with shorting wall 22, and is fastened at the free end of shorting strap 10.

Probes 6 and 9, together with shorting strap 10, form the coupling system for one polarization direction of a fundamental wave in waveguide antenna 1. As can be seen from FIG. 2, another similar coupling system, consisting of probes 12 and 13 and shorting strap 11, is located in the waveguide antenna 1, and positioned orthogonally to the first coupling system 6, 9, 10. The feed from an individual coaxial feed is not shown in the figures but corresponds to the feed already described for the first coupling system. The two shorting straps 10 and 11 are disposed in the vicinity of main axis A, intersecting one another so that there is no electrical contact. As can be seen from FIG. 1, this can be achieved by providing a vertical offset of the two shorting straps.

The length $L_o$ of probes 6, 9, 12, 13 is approximately ¼ of the operating wave length $\lambda$ of the waveguide antenna. Thus, shorting straps 10, 11, because of the distance of $\lambda/4$ from shorting wall 2, are in the idle state. The length $L_o$ of the probes may be variable, as can the diameter D of the probes and the distance S between them. Thus, the transition to the waveguide impedance, which is designed as a balancing network, can be adjusted.

With the aid of the transitions, the TEM wave that can propagate in coaxial feed 4 is converted into the fundamental wave type of waveguide 33. In a square waveguide, wave types $H_{01\square}$ and $H_{10\square}$ develop and/or orthogonal wave types $H_{11}$ develop in a round waveguide.

The radiation of the microwaves takes place through the aperture of waveguide antenna 1. The aperture plane in this case is located at a distance l from shorting straps 10, 11. By varying the length l in the range $0 \leqq l \leqq \lambda$ the secondary radiation contribution of the coupling device with a suitable amplitude and phase is superimposed on the radiation contribution of the waveguide aperture. As a result, degradations of the radiation pattern caused by coupling effects in array operation of a plurality of similar waveguide antennas 1 (=mutual coupling) can be compensated. This is a critical advantage of the proposed coupling device which is not achieved with known antenna elements such as patch or slot antennas.

Figure 2:
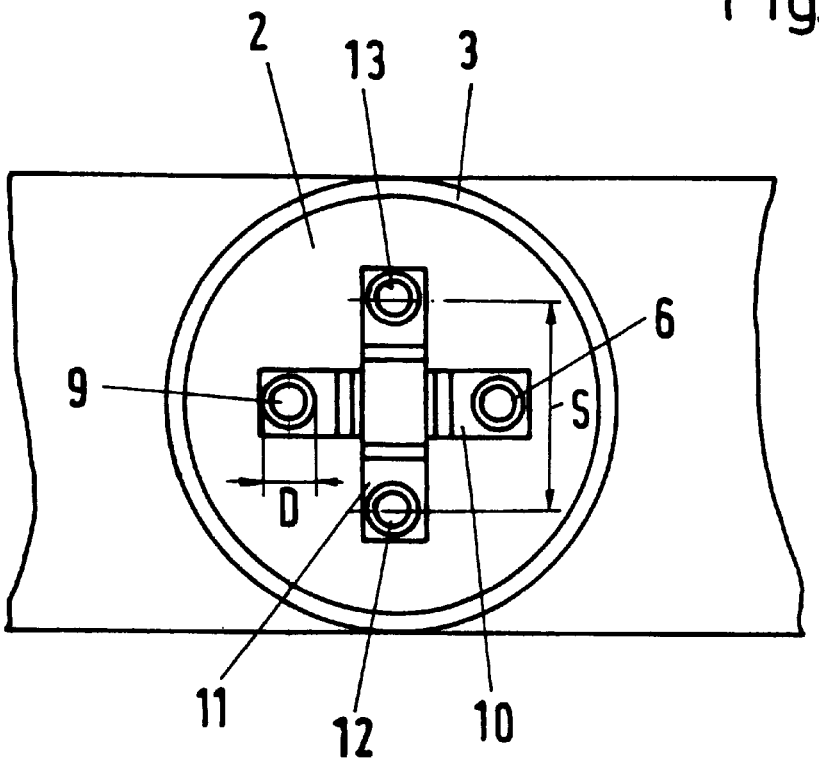
FIG. 2 is a top view corresponding to FIG. 1.

As can be seen clearly from FIG. 2 , the waveguide antenna is characterized by a very compact construction in the radial direction to the main beam axis A. As a result, especially close arrangement of a plurality of adjacent coupling devices is achieved, as is required in a waveguide array for example. The dimensions of such a waveguide array fall within the range of the dimensions of a plane patch array, while the waveguide array is distinguished by better electrical power data and an improved broadband characteristic by comparison.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Waveguide antenna comprising:

a waveguide section having an aperture disposed at an aperture side thereof, and a short-circuit wall with an eccentrically located opening therein;

a coaxial feed; and a transition from the coaxial feed to the waveguide section; wherein the waveguide section of waveguide antenna has a length $L=L_o+1$, wherein $L_o=\frac{1}{4}\lambda$; $0\leqq 1\leqq\lambda$; and $\lambda$=operating wavelength;

a signal fed from the coaxial feed is coupled through the eccentrically located opening in the short-circuit wall, with the aid of a first capacitatively acting coaxial probe, which probe comprises a pin and a sleeve partially surrounding the pin without contact, and is connected by a terminal with the central conductor of the coaxial feed; and a second probe with an external shape corresponding to an external shape of the first probe is conductively fastened to the short-circuit wall symmetrically relative to a main axis of the waveguide section, an end of the second probe on the aperture side being connected with the end of the first probe on the aperture side by means of a first shorting strap, said first and second probes and said first shorting strap forming a first coupling device.

2. The waveguide antenna according to claim 1 wherein the first and second probes have a length of approximately ¼ of the operating wavelength.

3. The waveguide antenna according to claim 1 further comprising a second coupling device located on the shorting wall orthogonally to the first coupling device, said second coupling device comprising third and fourth probes and a second shorting strap, and the first and second shorting straps being guided over one another without contact on or adjacent to a main axis of the waveguide section.

* * * * *